United States Patent [19]

Clifton

[11] Patent Number: 4,756,458

[45] Date of Patent: Jul. 12, 1988

[54] RECEPTACLE FOR WORK SUSPENDERS

[76] Inventor: Norman L. Clifton, 1155 N. 530 W., P.O. Box 979, Pleasant Grove, Utah 84062

[21] Appl. No.: 3,539

[22] Filed: Jan. 15, 1987

[51] Int. Cl.[4] ..... A45F 5/00

[52] U.S. Cl. ..... 224/252; 224/206; 24/10 R; 24/11 CT

[58] Field of Search ..... 224/206, 194, 251, 252, 224/253, 269, 904, 918, 914, 901; 24/3 F, 10 R, 10 A, 11 HC, 11 CT; 2/230; D2/626; D19/81

[56] References Cited

U.S. PATENT DOCUMENTS 897,064 8/1908 Crawford, Jr. ..... 24/3 F

*Primary Examiner*—Henry J. Recla
*Assistant Examiner*—David Voorhees
*Attorney, Agent, or Firm*—Lynn G. Foster

[57] ABSTRACT

A receptacle for a pencil, tool or the like which is initially slidably carried upon a workman's suspender strap by use of loops. Typically, after the suspenders have been adjusted and sized to fit the body and suit the preferences of the workman intending to use the suspenders, the receptacle is axially displaced along and relative to the associated suspender strap until a location satisfying the desires of the workman is found whereupon the receptacle is stationarily anchored by one or more fasteners to the chosen suspender site so that inadvertent relative axial displacement thereafter is prevented.

10 Claims, 1 Drawing Sheet

RECEPTACLE FOR WORK SUSPENDERS

FIELD OF INVENTION

The present invention relates generally to facile provision of a readily available pencil, tool or the like, to a workman, such as a carpenter, and more particularly for a stable receptacle to be anchored to the suspenders of a workman in which a pencil, tool or the like is placed for facile use by the workman.

PRIOR ART

Holders for pencils, tools or the like heretofore proposed for mounting in association with the suspenders of a workman have lacked stability, frequently causing the workman to discard the holder and place the pencil, tool or the like in a less convenient location elsewhere for periodic use. For example, see U.S. 897,064, which uses a wire connector adjustably joining a pencil holder to a suspender strap, the wire connector being permanently joined to the pencil holder. The problem incident to the pencil holder proposed by U.S. Pat. No. 897,064 is that the wire connector depends upon a low magnitude of friction to retain the holder and the pencil in a desired, selected position. The force of gravity coupled with imposition of additional forces incident to the activities of the workman will inadvertently displace the pencil and holder to other uncomfortable, inconvenient and non-facile locations along the suspender strap. Also, when the workman-user voluntarily or involuntarily presses his chest area against a solid structure during the course of his work, the metal clip of U.S. Pat. No. 897,064 will break the pencil.

BRIEF SUMMARY AND OBJECTS OF THE INVENTION

In brief summary, the present invention comprises a receptacle for a pencil, tool or the like which is initially slidably carried upon a workman's suspender strap whereby, after the workman's suspenders have been adjusted and sized to fit the body and suit the preferences of the workman intending to use the suspenders, the receptacle is axially advanced along and relative to the associated suspender strap until a location satisfying the desires of the workman is found whereupon the receptacle is stationarily anchored to the chosen suspender site so that inadvertent relative displacement thereafter is prevented.

With the foregoing in mind, it is a primary object of the present invention to overcome the problems of the aforementioned prior art by providing a novel stable receptacle for a pencil, tool or the like which reliably and stationarily suspends the receptacle from the suspenders of the workman.

An additional significant object is the provision of a novel receptacle for a pencil, tool or the like which can be initially adjusted along a suspender strap to a desired location and then stationarily anchored to the strap to prevent undesired subsequent relative displacement.

Another dominant object of the present invention is the provision of a novel receptacle for a pencil, tool or the like which is initially slidably joined to a suspender strap, to accommodate adjustment of the receptacle in relationship to the strap for convenient access to the pencil in the receptacle and to suit the preferences of the user, and which is thereafter stationarily anchored to the strap at the selected location against undesired subsequent relative displacement.

These and other objects and features of the present invention will be apparent from the detailed description taken with reference to the accompanying drawings.

DETAILED DESCRIPTION OF THE ILLUSTRATED EMBODIMENTS

Figure 1:
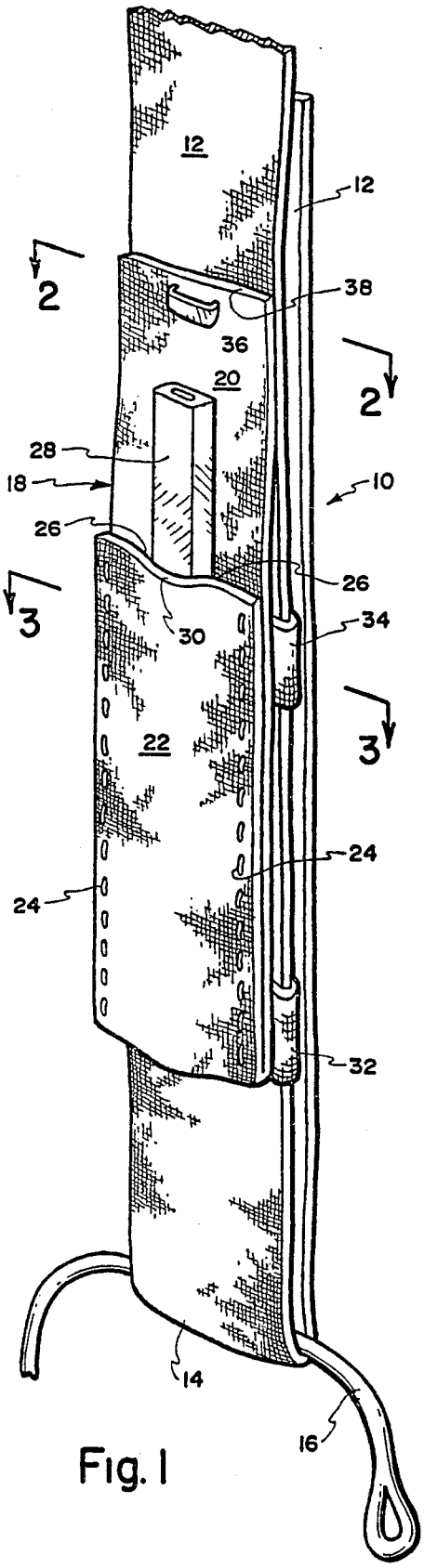
FIG. 1 is a fragmentary perspective of a presently preferred receptacle for a pencil, tool or the like, formed in accordance with the principles of the present invention, shown anchored in a convenient, accessible location to a suspender strap.
Figure 2:
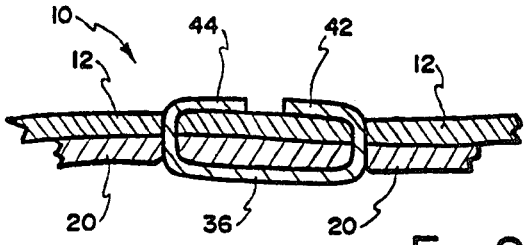
FIG. 2 is a transverse cross-section taken along lines 2—2 of FIG. 1.
Figure 3:
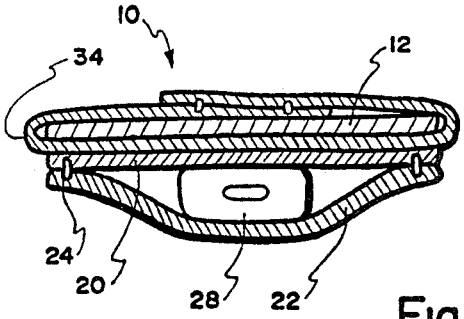
FIG. 3 is a transverse cross-section taken along lines 30—3 of FIG. 1.

Reference is now made to the drawings and particularly to FIGS. 1-3, which illustrate a presently preferred receptacle embodiment predicated upon the implementation of the principles of the present invention. This embodiment is generally designated 10. In its broadest connotation, the present invention includes a pair of suspenders, one strap 12 of which is illustrated as being turned upon itself through 180 degrees at site 14 at which site the strap 12 is joined to a conventional trouser-engaging connector 16. The suspender strap 12 is preferably of the type that is worn by a worker, such as a carpenter, during the performance of his responsibilities. One suitable type of strap comprises a woven material of synthetic resinous material, which is relatively thin, but comparatively wide. The advantage of using nylon or some other type of synthetic resinous material in woven form is that the expect life of these materials is long-term.

The present invention also comprises a receptacle, generally designated 18, where a pencil, tool or the like is removably placed. The receptacle 18 comprises a rear layer of the sheet material 20 and a front layer of sheet material 22. In the illustrated embodiment, the layer 20 and the layer 22 are formed of a single continuous piece of sheet material, which may be woven synthetic resinous material. The width of the sheet layers 20 and 22 is illustrated as being substantially the same as the width of the suspender strap 12. The axial distance spanned by the rear layer 20 is substantially greater than the axial distance spanned by the front layer 22. The superimposed edges of the layers 20 and 22 are secured one to another along the sides by sewn stitching 24. Thus, a pocket 26 is formed between the front surface of the layer 20 and the back surface of the layer 22.

As can be seen from inspection of FIG. 1, the overall axial length of the layer 22 is such that a new pencil 28 or the like, illustrated as being a carpenter's pencil, is substantially exposed above the top edge 30 of the layer 22 for ready access by the user. The axial length of the layer 20 may be on the order of the length of the new pencil 28, being illustrated as slightly greater in FIG. 1, to expose the upper end of layer 20 for purposes yet to be explained.

The receptacle 18 also comprises a lower loop 32 and an intermediate loop 34. Other than their respective locations, loops 32 and 34 are illustrated as being identical. Each is preferably formed of a sheet material which is flexible, such as woven synthetic resinous material. Initially, the loops 32 and 34 may, respectively, be a linear piece of sheet material, which is looped upon itself and secured to itself to form a ring-like member. Approximately one-half of each loop 32 and 34 is illustrated as being secured by adhesive, stitching, fasteners or the like to the back surface of the back layer 20, so that movement of either loop 32 and 34 in respect to the remainder of the receptacle 18 does not occur. The loops 32 and 34 are sized and shaped so as to form a central opening substantially the same in area as the cross-sectional area of the strap 10. This can be done either by forming the loops 32 and 34 directly around the strap 12 or by appropriately pre-sizing the loops 32 and 34 and slipping those loops over the strap 12 as the suspenders are assembled. In either event, the loops 32 and 34 slidably encircle the strap 12 thereby accommodating manual displacement of the receptacle 18 along the axis of the strap 12. In this way, the receptacle 18 can be located as desired at the just area of the user, usually following adjustment of the suspenders comprising the strap 12 to the particular size and preferences of the wearer.

Ordinarily, with the suspenders comprising strap 12 in place on the wearer, the receptacle 18 is axially displaced relative to the strap 12 up or down as the case may require until a desired site along the strap 12 is found which satisfies the preferences of the user and provides ready access to the pencil 28 or the like. At this point in time, the receptacle 18 is stationarily united with the region of the strap 12 which is contiguous with the back side of the layer 20 in such a way that further undesired relative axial displacement may not thereafter occur. One preferred way of achieving this inseperable union is to drive a metal staple 36 through the layer 20, from front to back, adjacent the upper edge 38 thereof and also through the strap 12. The prongs penetrating the layer 20 and strap 12 are crimped or bent through essentially 90 degrees as illustrated in FIG. 2.

Figure 4:
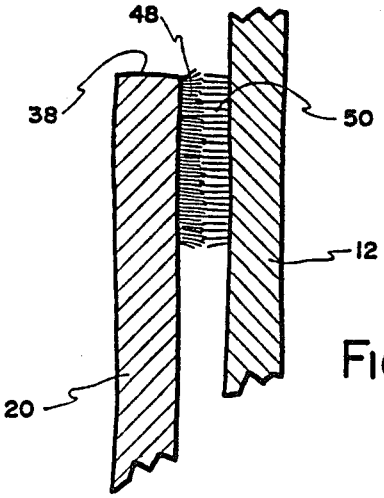
FIG. 4 is a longitudinal fragmentary cross-section of a second presently preferred receptacle for a pencil, tool or the like formed according to the present invention.

Another embodiment of the present invention for creating the mentioned stationary union is illustrated in FIG. 4 wherein Velcro fasteners 48 and 50 are interposed between the back surface of the layer 20 and the front surface of the strap 12, velcro fastener piece 48 being secured by adhesive, stitching or the like to the back surface of the layer 20 adjacent the edge 38 and the Velcro fastening piece 50 being secured likewise to the front surface of the strap 12 so as to be in direct alignment with the Velcro fastening piece 48. While the Velcro technique of FIG. 4 is not as permanent in the manner in which the receptacle 18 is secured to the strap 12, it is adequate so as to prevent undesired inadvertent axial displacement of the receptacle 18 in respect to the strap 12, once the selected site for the receptacle 18 has been chosen.

The invention may be embodied in other specific forms without department from the spirit or essential characteristics thereof. The present embodiments, are, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by United States Letters Patent is:

1. A claspless receptacle for a pencil, tool or the like comprising:

pocket means comprising a pliant front, a pliant back and an opening between the front and back through which a pencil, tool or the like is selectively inserted and removed;

means which initially slidably join the receptacle to a suspender strap for manual relative axial displacement therebetween to selectively locate the receptacle at a convenient site accessible to a user;

fastener means by which the receptacle is held fixed to the suspender strap at said selection location thereafter preventing relative forcible axial displacement between the receptacle and the suspender straps.

2. A receptacle according to claim 1, wherein the front and back of the pocket means each comprise:

a layer of sheet material, the layers being secured to each other along the bottom and sides, but open at the top thereof.

3. A receptacle according to claim 2, wherein the layers are sheets of woven fabric material secured to each other as indicated at least in part by stitching.

4. A receptacle according to claim 2, wherein the two layers comprise:

a single continuous piece of material double back upon itself at the bottom of the pocket means.

5. A receptable according to claim 1, wherein the pocket means comprise:

a flat front layer of material superimposed over a flat back layer, the back layer being co-extensive with the front layer, the front layer having a predetermined length less than the length of the back layer such that the back layer projects upward a substantial distance above the top edge of the front layer.

6. A receptacle according to claim 1, wherein the slidably joining means comprise:

at least one transverse loop securely fastened to the receptacle and slidably encircling the suspender strap.

7. A receptacle according to claim 1, wherein the slidably joining means comprise:

at least two spaced transverse loops each securely fastened to the receptacle and slidably encircling the suspender strap.

8. A receptacle according to claim 1, wherein the fastening means comprise stable means which pass through both the receptacle and the strap.

9. In combination, a pair of workman's suspenders comprising at least two straps and a claspless receptacle for a pencil, tool or the like, the receptacle comprising:

pocket means of pliant material including an opening through which a pencil, tool or the like is selectively inserted and removed;

pliant means which slidably join the receptacle to a suspender strap for manual relative axial displacement to selectively locate the receptacle for convenient access by a user;

fastener means which are interposed out of alignment with the pencil receiving part of the pocket means between the suspender strap adn the receptacle and by which the receptacle is held fixed to the suspender strap to retain the receptacle at said selected location against undesired sliding relative axial displacement whereby the superimposed portion of the suspenders and the receptacle are collectively pliant and yieldable both to the front and to the rear of pencil, tool or the like and the fastener means are spaced from the location of the pencil, tool or the like so that breakage of the pencil, tool or the like is substantially alleviated.

10. A method of selectively locating a receptacle for a pencil, tool or the like in respect to a suspender strap and of retaining the selected location, comprising the steps of:

causing a receptacle comprising pocket means to receive a pencil, tool or the like to be initially axially slidably carried upon a suspender strap;

selectively axially slidably displacing the receptacle along the suspender strap until a desired convenient site for the pocket means is achieved;

thereafter interposing fastening structure between the receptacle and the suspender strap at the selected site out of superposition with the pocket means to firmly hold the receptacle against undesired subsequent forcible relative sliding axial displacement.

* * * * *